United States Patent [19]

Livernois

[11] 4,325,148

[45] Apr. 20, 1982

[54] UNIFORMS FOR ICE HOCKEY PLAYERS

[75] Inventor: John Livernois, St. Jean, Canada

[73] Assignee: Canada Cycle and Motor Company Limited, Weston, Canada

[21] Appl. No.: 155,045

[22] Filed: May 30, 1980

[30] Foreign Application Priority Data

Apr. 23, 1980 [CA] Canada ..... 350445

[51] Int. Cl.[3] ..... A41D 13/00

[52] U.S. Cl. ..... 2/2; 2/22

[58] Field of Search ..... 2/2 R, 22, 23, 24, 227

[56] References Cited

U.S. PATENT DOCUMENTS

| | | | |
|---|---|---|---|
| 759,765 | 5/1904 | Stall | 2/23 |
| 1,612,766 | 12/1926 | Levinson | 2/22 |
| 1,803,335 | 5/1931 | Levinson | 2/2 |
| 1,805,734 | 5/1931 | Jones | 2/2 |
| 1,915,754 | 6/1933 | O'Shea | 2/2 |
| 2,239,223 | 4/1941 | Gilman | 2/2 |
| 3,170,163 | 2/1965 | Mitchell | 2/2 |
| 3,670,339 | 6/1972 | Cooper et al. | 2/24 X |
| 3,787,892 | 1/1974 | Quinn | 2/2 |
| 4,091,466 | 5/1978 | Kearn | 2/23 |

FOREIGN PATENT DOCUMENTS

| | | | |
|---|---|---|---|
| 951451 | 7/1974 | Canada . | |
| 963202 | 2/1975 | Canada . | |
| 964001 | 3/1975 | Canada . | |
| 971703 | 7/1975 | Canada | 2/23 |

*Primary Examiner*—Louis Rimrodt

*Attorney, Agent, or Firm*—Rogers, Bereskin & Parr

[57] ABSTRACT

An improved uniform for ice hockey players is disclosed which provides improved protection for the player and a more streamlined appearance compared with traditional uniforms. The uniform includes an inner protective garment for the lower portion of a wearer's torso including the hips and the thighs, and an outer garment in the form of a long-legged pant to be worn over the inner protective garment and conventional shin pads. The inner garment comprises a shell provided with a plurality of pockets capable of receiving protective pads and including flap-like pouches at the sides of the shell for receiving hip pads. The pouches have lower portions which are free of attachment to the shell so as to permit relative movement of the underlying parts of the shell and allow a wearer reasonable freedom of bending movement at the hips. The pant includes ventilation panels for permitting air to pass through the garment.

10 Claims, 11 Drawing Figures

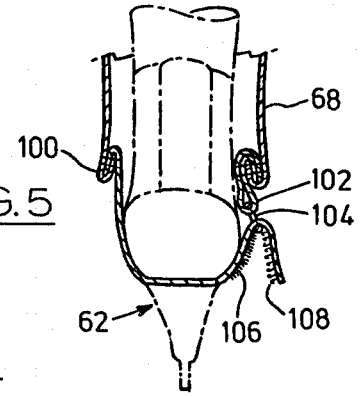
FIG. 5
FIG. 6
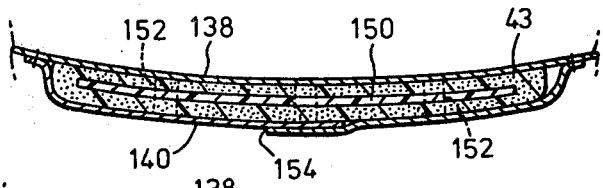
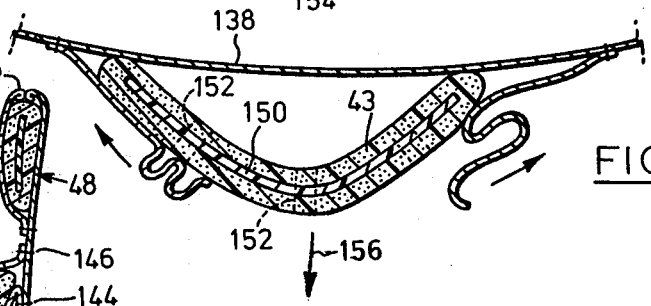
FIG. 7
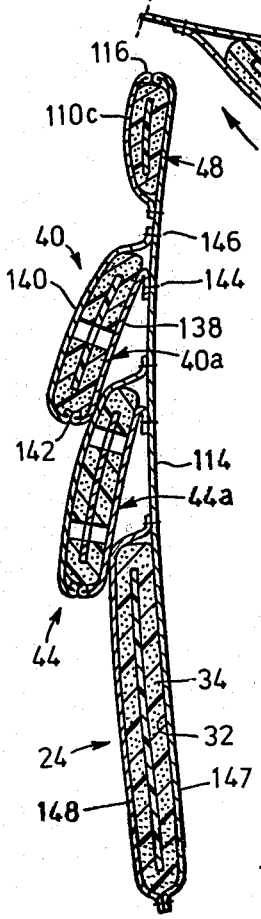
FIG. 8
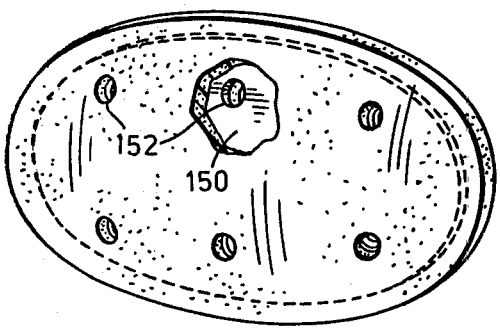
FIG. 9

UNIFORMS FOR ICE HOCKEY PLAYERS

This invention relates generally to uniforms for ice hockey players and is concerned more particularly with garments to be intended to be worn as part of a hockey uniform.

Hockey uniforms are normally made up of a number of separate garments, traditionally including a jersey, short pants and socks. Protective pads for the front thigh and tail-bone areas are normally incorporated in the pants and a player will usually wear separate shin pads under the socks and shoulder pads under the jersey. The socks are suspended by a garter belt and suspenders worn under the pants.

The traditional hockey uniform has been used universally for many years. However, various proposals have been made for streamlining and simplifying the uniform and providing improved protection for the wearer. By way of example, Canadian Pat. No. 951,451 (Delaney) discloses a proposal for an integrally padded one-piece suit for hockey players. Canadian Pat. Nos. 963,202 (Quinn); 964,001 (Noreen); and, 971,703 (Atack et al.) disclose examples of one-piece garments intended to be worn on the lower torso and legs of hockey players.

To date, none of the proposed garments have found wide acceptance among players. While traditional preferences do play a part in the reluctance of players to accept new garments, in many cases the garments themselves are unacceptable because they unduly restrict the freedom of movement of the wearer.

An object of the present invention is to provide improved garments for ice hockey players.

According to one aspect of the invention, there is provided an inner protective garment comprising a one-piece shell including a body portion of generally tubular shape dimensioned to fit closely around the lower portion of a wearer's torso including the hips, and a pair of tubular leg portions extending outwardly from the body portion over a distance sufficient to at least substantially completely enclose the wearer's thighs. The shell is provided with a plurality of pockets capable of receiving protective pads and including at least one pocket in a rear central area of the body portion intended to receive a tail-bone protector pad and at least one pocket in each of leg portions of the shell. The leg pockets extend over substantially the entire length of and encircle substantially the entire circumference of the leg portion including at least the sides of the portions. The garment further includes at least one flap-like pouch secured to each side of the shell. The pouches are shaped and arranged to cover the hips of a wearer and form pockets for receiving protective hip pads and each said pouch includes a lower portion which is free of attachment to the shell so as to permit relative movement of the underlying parts of the shell and allow a wearer reasonable freedom of bending movement at the hips.

According to another aspect of the invention there is provided an outer garment intended to be worn by an ice hockey player over an inner protective garment, the outer garment being in the form of a long legged pant comprising a body portion shaped to fit around the lower portion of a wearer's torso over said inner protective garment, and a pair of tubular leg portions extending outwardly from said body portion and of a length to extend down to and cover the ankles of a wearer. The garment includes a plurality of ventilation panels made of a material which provides openings for permitting air to enter the garment. These panels include a body panel which extends from front to rear of the body portion between the leg portions, two leg panels in the form of relatively narrow elongate strips which extend down the insides of the respective leg portions from the body portion to the ankle area, and a panel in the front of each leg portion below the knee area. Each of the leg portions is further provided with a protective pad having the shape of a band, which extends across the front of the leg portion at a position above the knee area selected so that the band will be located immediately above the top of a shin pad worn below the garment.

In order that the invention may be more clearly understood, reference will now be made to the accompanying drawings which illustrate preferred forms of garment in accordance with the invention, and in which:

FIG. 5 is a vertical sectional view generally on line V—V of FIG. 3;

FIG. 6 is a horizontal sectional view generally on line VI—VI of FIG. 1, showing one of the protective pads of the garment;

FIG. 7 is a view similar to FIG. 6 illustrating the manner in which the pad can be removed from the garment;

FIG. 8 is a vertical sectional view on line VIII—VIII of FIG. 1;

FIG. 9 is a perspective view, partly broken away, of a typical one of the protective pads used in the garment of FIGS. 1 and 2;

Figure 2:
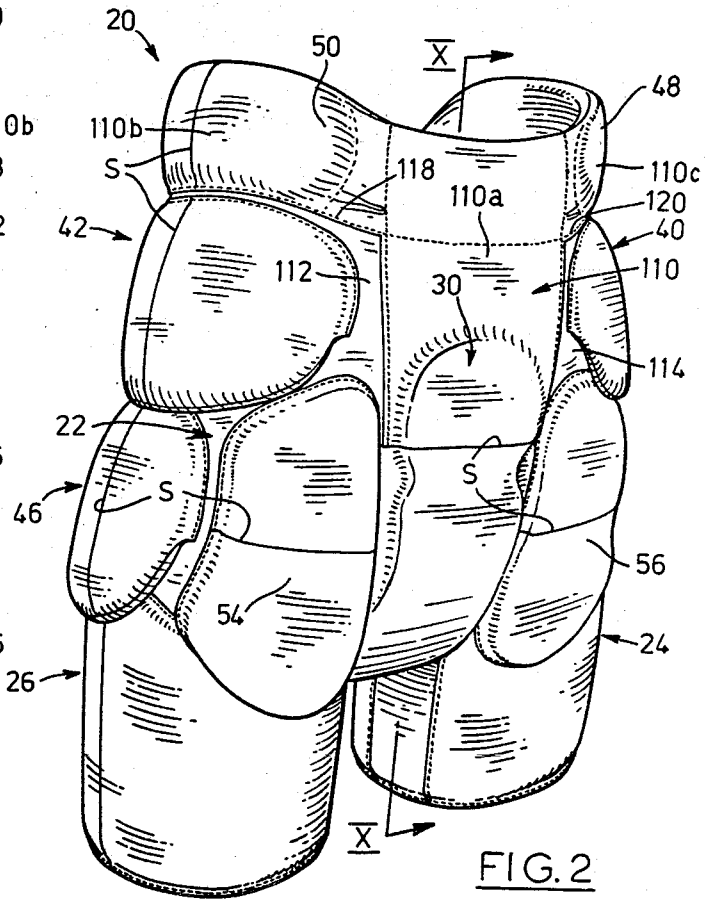
FIGS. 1 and 2 are front and rear perspective views respectively of an inner protective garment according to the invention, the garment being shown approximately in the position it will adopt in wear.
Figure 1:
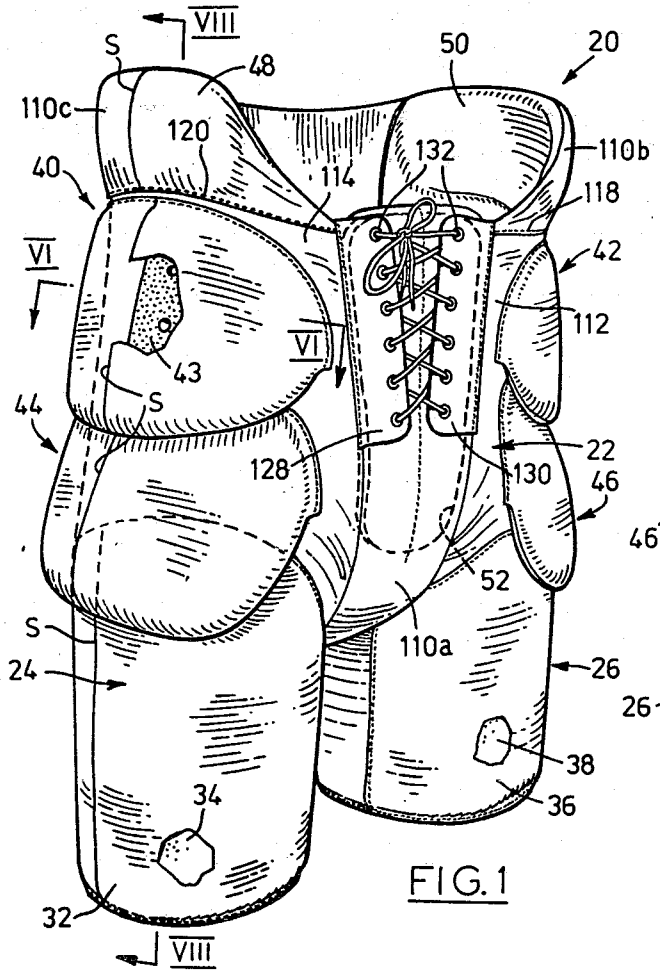
Figure 3:
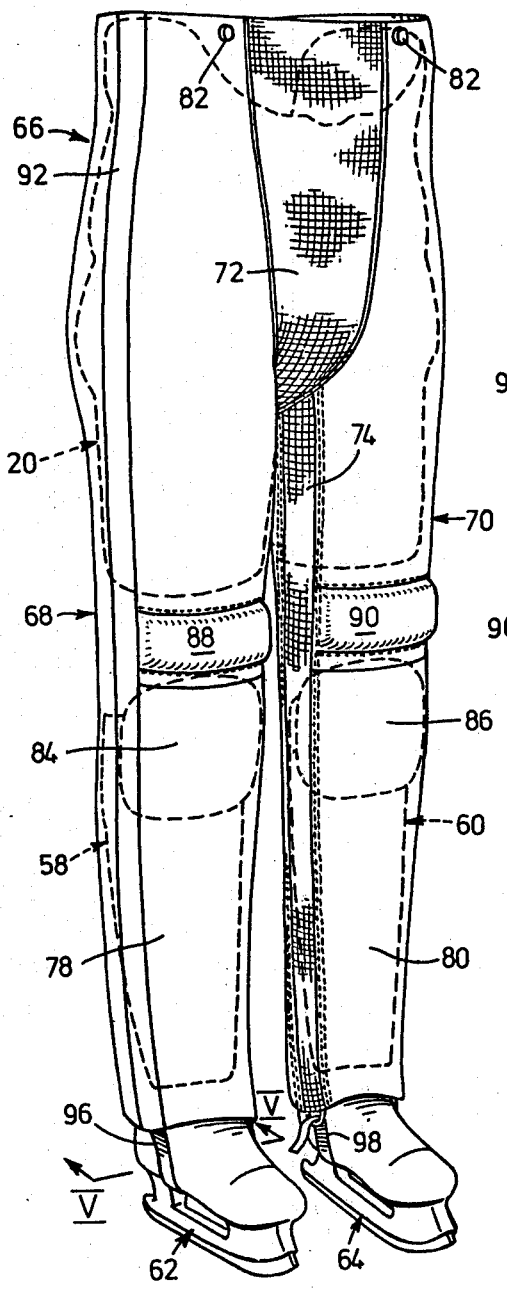
FIGS. 3 and 4 are front and rear perspective views respectively of an outer garment according to the invention, the garment again being shown as in wear.
Figure 4:
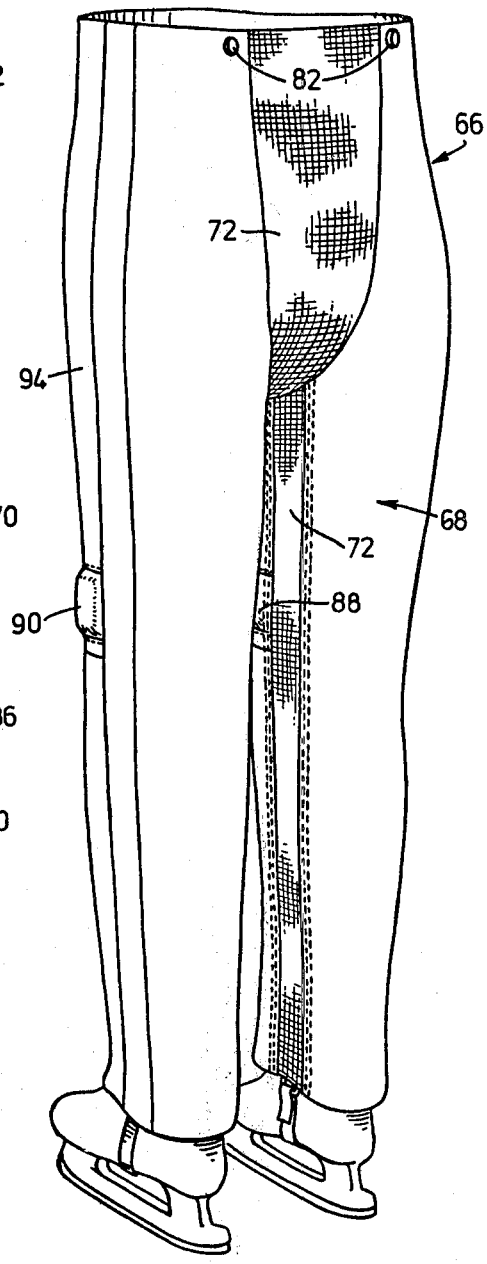

Before referring to the drawings in detail, it should be noted that the inner protective garment of FIGS. 1 and 2 and the outer garment of FIGS. 3 and 4 are intended to be used together as the principal parts of a hockey uniform, although it is to be noted that the garments need not essentially be used together. The remainder of the uniform will include a jersey to be worn over a conventional shoulder pads and elbow pads at the top of the player's body, and conventional shin pads one below the outer garment.

Referring now to the drawings, and particularly to FIGS. 1 and 2, the inner protective garment is generally indicated by reference numeral 20 and comprises a one-piece shell made up of a body portion 22 of generally tubular shape dimensioned to fit closely around the lower portion of a wearer's torso including the hips, and a pair of tubular leg portions 24 and 26 extending outwardly from the body portion over a distance sufficient to at least substantially completely enclose the wearer's thighs. The shell is provided with a number of pockets capable of receiving protective pads. The pockets will be fully described later but for present purposes it is sufficient to note that the pockets include at least one pocket in a rear central area of the body portion of the shell intended to receive a tail-bone protector pad and at least one pocket in each of the leg portions of the shell. The pocket for the tail-bone protector pad is indicated by reference numeral 28 in FIGS. 10 and 11 and the pad itself is denoted 30 and is also visible in outline in FIG. 2. One of the leg pockets (in leg portion 24) is indicated by reference numeral 32 in FIG. 8 and the pad in the pocket is denoted 34. The pad and pocket are similarly denoted in FIGS. 1 and 2 using dotted lead lines. The corresponding pad and pocket for leg portion 26 are similarly indicated by reference numerals 36 and 38 respectively in FIGS. 1 and 2. The leg pockets extend over substantially the entire length of and encircle substantially the entire circumference of the leg portions of the shell including at least the sides of the leg portions, so as to provide substantially complete protective coverings for the sides of the wearer.

The inner garment further includes two flap-like pouches, denoted 40 and 42, which are secured to the shell and which are shaped and arranged to cover the hips of wearer. The pouches form pockets for receiving protective hip pads, part of one of which is visible at 43 in FIG. 1. Each pouch has a lower portion which is free of attachment to the shell so as to permit relative movement of the underlying parts of the shell and allow a wearer reasonable freedom of bending movement at the hips. FIG. 8 best illustrates this free lower portion of the hip pouch in the case of pouch 40; the pouch 42 at the opposite side of the shell is similar.

In the illustrated embodiment, two similar, intermediate pouches 44 and 46 are provided between the respective hip pouches 40 and 42 and the leg protector pads 34 and 38. These intermediate pouches are essentially the same as the pouches 40 and 42 although of slightly different shape (see FIG. 2). These pouches too have lower portions which are free of attachment to the shell as best seen in FIG. 8 in the case of pouch 44. It will be noted that the lower portion of pouch 40 partly overlies the intermediate pouch 44 immediately below it and that the lower portion 44*a* of that pouch itself partly overlies the corresponding pocket 32 in the leg portion of the shell. It will be appreciated that, as such, the hip, intermediate and side pads at each side of the shell cooperate to provide substantially complete protective coverage for the hip and thigh areas of a wearer while allowing reasonable freedom of bending movement at the wearer's hips. During such movement, the lower portion of each of the hip pouches (40 and 42) will be able to slide on the intermediate pouch below while those pouches themselves will slide with respect to the thigh pads, and complete protective coverage will be maintained.

Garment 20 also includes a number of further pockets capable of receiving protective pads. Specifically, two additional pockets indicated at 48 and 50 are provided in a waistband portion of the garment for providing protection around the bottom of the wearer's rib cage. In addition, a fly pad indicated in dotted outline at 52 is provided in the front of the body portion of the shell. This pad is intended to provide protection additional to that afforded by the normal protective cup worn by hockey players. While it would be possible to incorporate a cup in the shell, it is believed that a separate cup worn underneath the protective garment may be preferred. Finally, the shell includes two further pockets indicated at 54 and 56 in FIG. 2 disposed on respectively opposite sides of the tail-bone pocket for receiving pads to protect the areas on either side of the wearer's tail-bone.

It will be appreciated from the foregoing description that, with pads in place in all of the pockets in the garment, the wearer will be provided with substantially complete all-round protection in the area of the lower torso. The pockets are all designed so that individual pads can be removed according to player preference. For example, in the case of a garment intended to be worn by a defenceman, the player might prefer to retain all of the pads, while a forward might prefer to remove, for example, the pads in the intermediate pouches 44 and 46 and the pads in the pockets 54 and 56 on either side of the tail-bone.

Details of the construction of the inner garment will be described later primarily with reference to FIGS. 6 to 11. In the meantime, the outer garment intended to be worn over the garment shown in FIGS. 1 and 2 will be described with reference to FIGS. 3 to 5.

The outer garment is generally in the form of a long-legged pant and will be made of a size sufficiently large to comfortably fit over the inner garment and a pair of conventional shin pads. In FIG. 3, the inner garment is shown in dotted outline at 20 and a pair of shin pads are indicated at 58 and 60. Skates to be worn by the player are shown in ghost outline at 62 and 64. The garment itself comprises a body portion 66 shaped to fit around the lower portion of a wearer's torso over the inner protective garment 20, and a pair of tubular leg portions 68 and 70 which extend outwardly from the body portion 66 and which are of a length to extend down to and cover the ankles of the wearer. The garment includes a plurality of ventilation panels made of a material which provides openings for permitting air to pass through the garment. These garments include a body panel 72 which extends from front to rear of the body portion 66 between the leg portions 68 and 70 and two leg panels 74 and 76 in the form of relatively narrow elongate strips which extend down the insides of the respective leg portions from the body portion to the ankle area. Ventilation panels 78 and 80 are also provided in the front regions of the leg portions 68 and 70.

When the garment is in wear, air can enter through one or more of the ventilated panels, circulate around the wearer's body, and leave the garment, making for comfortable wearing of the garment. The garment will be a relatively loose fit to allow for this air circulation and will not be tightly held around the waist area of a wearer so that some of the ventilation air can pass upwardly below the jersey and reach the upper portion of the wearer's body. The garment will be held in place by suspenders attached to buttons 82 in the waistband area of the garment.

The ventilation panels 78 and 80 extend up the leg portions of the garment to a position just below the knee area. Immediately above the panels, patches 84 and 86 are secured to the leg portions of the garment to provide a double thickness of material in the knee area for wear resistance (e.g. for those occasions in which the player might have to fall to his knees on the ice).

Protective pads 88 and 90 are provided on each of the leg portions of the garment immediately above the knee area and are permanently secured in pockets formed in the garment. The pads themselves will be of the same form as the pads in the inner protective garment (see later). The pads are located so that, when the garment is in wear, they will be disposed immediately above the shin pads 58 and 60 so as to protect the area of the wearer's thighs which would otherwise be exposed between the shin pads and the inner protective garment. In practice, the outer garment (pant) will be made available in a range of sizes selected to be used with corresponding sizes of inner garment and the pads 88 and 90 will be positioned to exactly fill the space between the inner garment and the shin pads.

The pant is constructed by conventional garment manufacturing techniques from cut sections of fabric sewn together. The sections which form the ventilated panels 72, 74, 76, 78 and 80 are made of LYCRA (trademark) fabric. This fabric has the characteristic of a relatively open weave to provide for the required ventilation, and at the same time is stretchable both laterally and longitudinally. Accordingly, in addition to providing ventilation, the LYCRA panels provide the garment with some stretchability so as to facilitate putting on and taking off of the garment and allow some latitude for variations in size of wearer. The sections which make up the remainder of the garment are made of 420 denier nylon fabric. The respective fabrics can be obtained in various colours so that the pant can be manufactured to the required team colours. All of the panels may in fact be the same colour. Decorative stripes indicated at 92 and 94 are shown on the outside leg seams in FIGS. 3 and 4 but are not essential to the construction to the construction of the garment.

In order to maintain a "smooth" and "clean" appearance in wear, it is desirable that the leg portions of the garment should be prevented from riding up during skating. For this purpose, hold-down straps are provided at the bottoms of the leg portions of the garment and are indicated at 96 and 98. Strap 96 is shown in detail in FIG. 5 and it will be seen that the strap is attached to the leg portion of the garment at one side and is intended to be looped below the sole of the skate boot at 62 and attached to the leg portion at the opposite side. Each of the straps is in the form of a strip of nylon webbing sewn to the leg portion of the garment at one end. Some of the stitching securing the strap is indicated at 100. A somewhat shorter strip of the same material is formed into a loop 102 which is stitched to the leg portion at the side opposite stitches 100, and which carries an eye 104. Adjacent its outer end, strap 96 is provided with two sections 106 and 108 of cohesive VELCRO (trademark) fabric spaced along the strap. This allows the strap to be looped through eye 104 and secured back on itself by means of the VELCRO fabrics. The effective length of the strap and hence the tightness with which the legs of the garment are held down can be adjusted by adjusting the positions at which the VELCRO fabrics are attached together.

Reference will now be made to FIGS. 6 to 11 in conjunction with FIGS. 1 and 2 in describing the construction of the inner protective garment 20 in more detail. The garment is constructed from the same LYCRA fabric as is used for the ventilated panels of the pant. This provides some ventilation for the inner garment too as well as stretability. The garment will be made available in a number of sizes and will be designed to be a relatively snug fit. At the same time, the LYCRA will allow some flexibility in sizing as well as permitting a degree of "give" when the wearer moves.

Referring back to FIGS. 1 and 2, the body portion of the garment is made up of a central panel 110 and two side panels 112 and 114 stitched together using conventional garment manufacturing techniques. The central panel 110 is somewhat T-shaped as cut and includes a main (stem) portion 110*a* and two side portions 110*b* and 110*c* which extend outwardly from the top of portion 110*a* (see FIG. 2). The main portion 110*a* of panel 110 extends down from the waistband of the garment at the back between the legs and up to the top of the garment at the front. The lateral portions 110*b* and 110*c* form the outer surface of the "waistband" of the garment (although this "waistband" will be positioned in wear somewhat higher than the normal waistband area of the wearer). The side panels 112 and 114 are stitched to respectively opposite side margins of the central portion 110*a* of panel 110 and extend around to form the sides of the shell of the garment below the pouches 40, 42, 44 and 46. The side panels also extend up behind the lateral portions 110*b* and 110*c* of panel 110 to form the inner surface of the waistband and are stitched to the lateral portions by lines of stitching such as that indicated at 116 in FIG. 8. The panels 112 and 114 are also stitched to the lower marginal edges of the lateral portions 110*b* and 110*c* of panel 110 by lines of stitching indicated at 118 and 120 in FIGS. 1 and 2. Part of stitching 120 is also visible in FIG. 8 and it will be seen that the two fabric layers which make up the waistband define the pockets for receiving the rib cage protector pads 48 and 50. The waistband terminates in downwardly inclined edges at the front of the garment which locate the pads 48 and 50 in one direction and lines of stitching 122 and 124 at the back of the garment prevent the pads from moving in the other direction.

Figure 10:
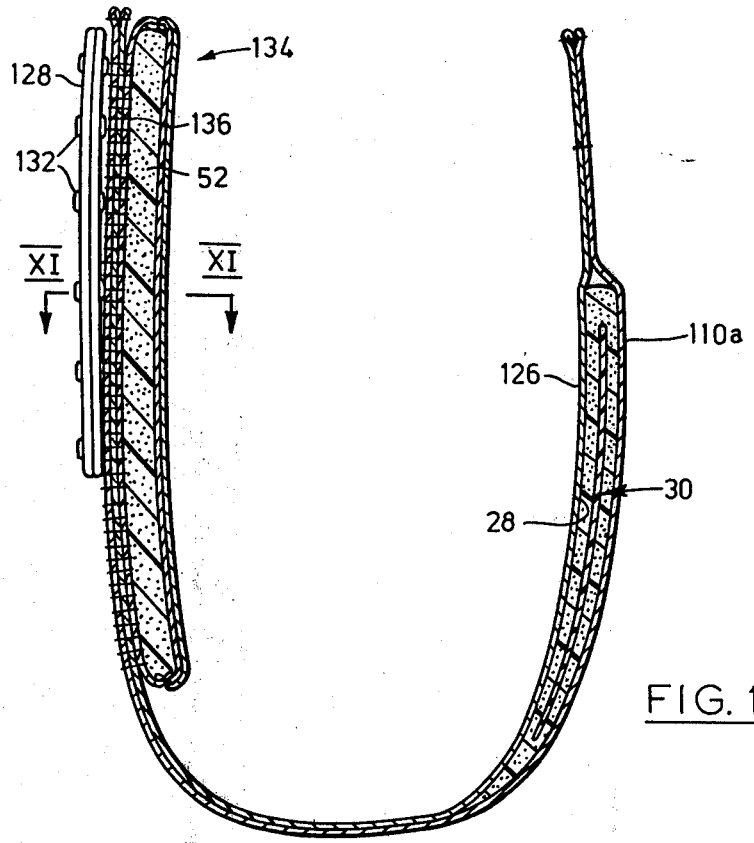
FIG. 10 is a vertical sectional view on line X—X of FIG. 2.
Figure 11:
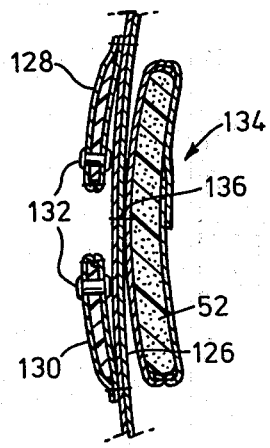
FIG. 11 is a horizontal sectional view on line XI—XI of FIG. 10.

An inner panel 126 overlies the main central portion 110*a* of panel 110 and is stitched thereto so that this portion of the panel is effectively of double thickness and defines the pocket 28 for receiving the tail-bone protector pad 30 of the garment (see FIG. 10).

At the front of the garment, the main portion 110*a* of panel 110 is also stitched to the side panels 112 and 114 by lines of stitching which are also used to secure lacing panels 128 and 130 to the garment. These panels are provided with eyelets 132 for receiving a lace 134 by which the garment can be drawn tightly around the torso of a wearer. The lacing panels are shown in cross-section in FIG. 11 and it will be seen that each panel is in fact formed by a double-wall pouch forming a pocket for a protective pad. The fly pad 52 referred to above is disposed immediately behind main panel portion 110*a* in the region of the lacing panels 128 and 130 and is itself received in a pouch 134 secured by stitching 136 to the inner surface of panel portion 110*a*.

Referring back to FIG. 8, each of the pouches 40, 42, 44 and 46 at the sides of the garment is formed by two layers of LYCRA fabric stitched together along their outer edges and stitched to the relevant side panel 112 or 114 of the shell of the garment along their inner edges as shown in the case of pouches 40 and 44. By way of example, pouch 44 comprises inner and outer layers 138 and 140 secured together by a line of stitching indicated at 142 and attached to the panel 114 by respective lines of stitching 144 and 146. In this way, the lower portion 40*a* of the pouch remains free of attachment to the shell of the garment as discussed above. This structure is also typical of the other three pouches 42, 44 and 46.

The side panels 112 and 114 of the garment shell are provided with oval-shaped openings around which the leg portions 24 and 26 are attached. Each of these leg portions is defined by a tubular section of fabric having an upper end shaped to match the body portion and stitched thereto. In FIG. 8, part of the section used to form leg portion 24 is indicated at 147. An appropriately shaped section of LYCRA fabric denoted 148 is stitched to the outside of section 146 to form the pocket 142 for receiving pad 34. The other leg portion 26 is of similar construction.

FIG. 9 shows a typical one of the protective pads used in the garment of FIGS. 1 and 2. The pad comprises an inner core 150 in the form of a flat section of relatively stiff polyethylene plastic embedded in non-coated rigid polyethylene foam. Suitable foam is available from a number of sources, but in this embodiment, the pads are made using MINI-CELL (trade mark) foam sold by Foam-Mate Limited. The core imparts stiffness to the pad and provides additional protection. Perforations 152 are provided in the pads for ventilation and lightness. All of the pads used in the garment are of this form except for the fly pad 52, which has no core. Each of the pads can be individually removed from its pocket in the manner illustrated in FIGS. 6 and 7. These views relate specifically to the hip pad 43 but it is to be understood that they are representative only and that all of the other pads may be removed in similar fashion. Thus, pad 43 is received in a pocket defined by inner and outer sections of LYCRA fabric denoted 138 and 140. The outer section is in fact made up of two pieces of fabric which are overlapped to define a slit 154 for providing access to the interior of the pocket. Since the LYCRA material from which the pocket is made is stretchable, the overlapping portions of the pocket can be readily pulled back as shown in FIG. 7 to allow the pad to be removed as indicated by arrow 156. All of the pockets in the garment are similarly constructed (except for the lacing panels 128 and 130) and the corresponding slits for other pockets are denoted by the letter S in FIGS. 1 and 2. Thus, appropriate one of the pads can be removed as required according to player preference.

It will of course be appreciated that the preceding description relates to particular embodiments of the invention and that many modifications are possible. For example, although specific constructional details have been given for the particular forms of garment shown in the drawings, these details are to be considered as representative only and the garments may of course be constructed in other ways. Also, in the case of the inner protective garment shown in FIGS. 1 and 2, some of the pads could be omitted from the garment as manufactured, or additional pads could be provided. For example, in the case of a garment designed specifically for a forward, say, the intermediate side pouches 44 and 46 could be omitted as could the pads in the pockets 54 and 56 at the rear of the garment. In a case in which only one pouch is provided at each side, the pouch could be made somewhat longer than the pouches 40 and 42 so as to partly overlie the pockets in the leg portions 24 and 26. Those portions themselves could have two or more individual pockets rather than a single almost cylindrical pocket as described so that the player could remove parts of the protective padding in that area if desired. Where a single pocket is retained, several separate pad sections could be used in each pocket for the same reason.

I claim:

1. An inner protective garment for an ice hockey player, comprising a one-piece shell including a body portion of generally tubular shape dimensioned to fit closely around the lower part of a wearer's torso including the hips, and a pair of tubular leg portions extending outwardly from the body portion over a distance sufficient to at least substantially completely enclose the wearer's thighs, said shell being provided with a plurality of pockets capable of receiving protective pads and including at least one pocket in a rear central area of said body portion intended to receive a tail-bone protector pad and at least one pocket in each of the leg portions of the shell, said leg pockets extending over substantially the entire length of and encircling substantially the entire circumference of the leg portions including at least the sides of said portions, the garment further including at least one flap-like pouch secured to each side of said shell, said pouches being shaped and arranged to cover the hips of a wearer and forming pockets for receiving protective hip pads and each said pouch including a lower portion which is free of attachment to the shell so as to permit relative movement of the underlying parts of said shell and allow a wearer reasonable freedom of bending movement at the hips.

2. A garment as claimed in claim 1, wherein two of said flap-like pouches are secured to each side of the shell and comprise an upper pouch forming said pocket for receiving a protective hip pad, and an intermediate pouch disposed between said upper pouch and said pocket in the leg portion of the shell, each of said pouches including a lower portion which is free of attachment to the shell, the lower portion of the said upper pouch partly overlying the intermediate pouch, and the lower portion of the intermediate pouch partly overlying the corresponding leg pocket so that pads in said pockets provide substantially complete protective cover for the hip and thigh areas of a wearer while permitting relative movement between the pads as the wearer moves.

3. A garment as claimed in claim 1, wherein said shell further defines a waistband portion arranged to extend around the torso of the wearer above said hip pad pockets, said waistband portion including two of said shell pockets shaped and arranged to receive protective pads for the lower rib cage area of the wearer.

4. A garment as claimed in claims 1, 2 or 3, wherein said shell further includes two of said pockets disposed on respectively opposite sides of said tail-bone pocket and adapted to receive additional pads for providing protection between said tail-bone region and said pouches at the sides of the shell, and wherein the garment further includes a pouch secured inside the shell in the fly area and adapted to receive a protective pad for the fly area of the wearer's torso.

5. A garment as claimed in claim 1, wherein each of said pockets, and each of said pouches includes an opening providing access to the interior of the pocket, whereby protective pads may be used selectively in some only of said pockets, according to player preference.

6. A garment as claimed in claim 1, wherein said shell and pouches are made entirely of a ventilated stretchable fabric.

7. A garment as claimed in claim 6, further comprising a pair of lacing panels disposed in a front region of said shell in spaced positions and attached to respectively opposite side portions of the shell, said lacing panels including eyelets receiving a lace which can be tightened to secure the garment firmly about a wearer's torso.

8. An outer garment intended to be worn by an ice hockey player over an inner protective garment, the outer garment being in the form of a long-legged pant comprising a body portion shaped to fit around the lower part of a wearer's torso over said inner protective garment and a pair of tubular leg portions extending outwardly from said body portion and of a length to extend down to and cover the ankles of a wearer, the garment including a plurality of ventilation panels made of a material of which provides openings for permitting air to pass through the garment, said panels including a body panel which extends from front to rear of the body portion between the leg portions, two leg panels in the form of relatively narrow elongate strips extending down the insides of the respective leg portions from the body portion to the ankle area, and panels in the front of each of said leg portions below the knee area, said leg portions each being further provided with a protective pad in the form of a band which extends across the front of said leg portion at a position above the knee area selected so that said band will be located immediately above the top of a shin pad worn below the outer garment.

9. A garment as claimed in claim 8, wherein each of said ventilation panels is made of a garment which is stretchable in addition to providing said ventilation openings.

10. A garment as claimed in claim 8, further comprising hold-down straps at the lower ends of said leg portions, each said strap being secured to said portion at a first end and being adapted to be looped below the sole of a skate boot, and means for securing an outer end of said strap to said leg portion at a position generally diametrally opposite said first end.

* * * * *